US011808107B2

(12) United States Patent
Triche et al.

(10) Patent No.: US 11,808,107 B2
(45) Date of Patent: Nov. 7, 2023

(54) BALL INJECTING APPARATUS AND METHOD FOR WELLBORE OPERATIONS

(71) Applicants: Shane Triche, Houma, LA (US); Heath Triche, Gray, LA (US)

(72) Inventors: Shane Triche, Houma, LA (US); Heath Triche, Gray, LA (US)

( * ) Notice: Subject to any disclaimer, the term of this patent is extended or adjusted under 35 U.S.C. 154(b) by 33 days.

(21) Appl. No.: 17/077,939

(22) Filed: Oct. 22, 2020

(65) Prior Publication Data

US 2021/0115754 A1 Apr. 22, 2021

Related U.S. Application Data

(60) Provisional application No. 62/924,537, filed on Oct. 22, 2019.

(51) Int. Cl.
*E21B 33/068* (2006.01)
*E21B 33/13* (2006.01)
*E21B 33/12* (2006.01)

(52) U.S. Cl.
CPC ..... *E21B 33/13* (2013.01); *E21B 33/068* (2013.01); *E21B 33/12* (2013.01)

(58) Field of Classification Search
CPC ..... E21B 33/13; E21B 33/12; E21B 33/068
See application file for complete search history.

(56) References Cited

U.S. PATENT DOCUMENTS 8,091,628 B2 * 1/2012 Peer ..... E21B 33/05 166/70
8,636,055 B2 * 1/2014 Young ..... E21B 33/068 15/104.062
8,869,883 B2 10/2014 McGuire et al.
9,103,183 B2 * 8/2015 He ..... E21B 33/068
9,447,652 B2 * 9/2016 Artherholt ..... E21B 34/14
9,739,111 B2 * 8/2017 Beason ..... E21B 33/068
10,378,302 B2 * 8/2019 Sinkewich ..... E21B 33/068
11,002,101 B2 * 5/2021 Golinowski ..... E21B 33/068
2008/0053660 A1 * 3/2008 Angman ..... E21B 33/16 166/373
2008/0223587 A1 * 9/2008 Cherewyk ..... E21B 33/068 166/69
2010/0288496 A1 * 11/2010 Cherewyk ..... E21B 43/14 166/284
2012/0152525 A1 * 6/2012 McGuire ..... B65D 83/0409 166/193
2012/0211219 A1 * 8/2012 McGuire ..... E21B 33/068 166/75.15
2014/0360720 A1 * 12/2014 Corbeil ..... E21B 33/068 166/284
2015/0021024 A1 * 1/2015 Artherholt ..... E21B 33/05 166/281
2016/0356112 A1 * 12/2016 Artherholt ..... E21B 33/05
2018/0313182 A1 * 11/2018 Cherewyk ..... E21B 33/068
2022/0081990 A1 * 3/2022 Bushman ..... E21B 34/02

* cited by examiner

*Primary Examiner* — Steven A MacDonald
(74) *Attorney, Agent, or Firm* — Heuton IP Law, LLC

(57) ABSTRACT

An apparatus for deploying a circular device such as a frac ball into a wellbore, and systems and methods for using the same, is provided. In various embodiments, the apparatus can have a magazine that biases the circular device upward, and then an actuator and slidebar move the circular device from the magazine down a chute and into a wellbore. The apparatus can be operated remotely to reduce the risk of harm to a human operator. Other aspects and features of the apparatus are described herein.

16 Claims, 7 Drawing Sheets

BALL INJECTING APPARATUS AND METHOD FOR WELLBORE OPERATIONS

CROSS REFERENCE TO RELATED APPLICATION

This application claims the benefit of U.S. Application Ser. No. 62/924,537, filed on Oct. 22, 2019, which is incorporated by reference in its entirety.

FIELD

The present disclosure relates to equipment used for well completion, re-completion or workover and, in particular, to injectors used to deploy frac balls or similar circular devices into a fluid stream pumped into a well during well completion, re-completion or workover operations.

BACKGROUND

In the oil and gas industry, once a wellbore is drilled, multiple layers of reservoirs or formations that are targets for productions are completed. However, each formation may contain different rock properties requiring different treatments. The varying treatments often require the formations to be isolated from one another during that treatment. Frac balls are often used to control fluid flow during these treatments in the wells. The frac balls are generally dropped or injected into the well at the wellhead to enter a fluid stream.

The dropping or injecting of circular devices is currently accomplished using manual or mechanical apparatuses and methods, but each has problems. For manual deployment, the largest, but not the only, problem is human proximity to pressurized equipment, which presents safety issues to a worker. For mechanical deployment, the largest, but not the only, problems are size, operability, and feasibility to adapt to multiple systems.

In addition, treating multiple formations requires frac balls in multiples sizes (diameters) that need to land at a predetermined locations downhole to perform as intended. Although technology exists to accomplish this, the availability of a single apparatus to deploy frac balls or similar circular devices into a well at atmospheric pressure or under well pressure with minimum to no physical human interaction, of a small manageable size with the ability to handle various diameters and quantities in excess of the currently available, and adjust to fit into multiple wellhead, frac head, night cap rig up systems does not. The present disclosure relates to apparatuses, systems, and methods that accomplish these functions and requirements during well completion, re-completion, workover and intervention operations.

SUMMARY

The present disclosure provides a system to deploy circular devices both at atmospheric pressure and under various well pressures with minimal human interaction at the wellhead, thus decreasing human exposure to unfavorable environmental conditions near the wellhead. The system can deploy multiple circular devices, such as frac balls, into a well using a collaboration of mechanical and electrical technology. The system can integrate into well drilling, completion, and intervention operations and can be incorporated on land, at sea, and subsea at atmospheric or elevated pressures.

An objective of the disclosure is to provide apparatuses, systems, and methods to ease rig up operations and usage by being capable of remaining small in size to eliminate working at height, having minimal parts to reduce the need for servicing, and swiveling into and out of position during execution.

Another objective of the disclosure is to provide the ability to integrate into new as well as existing wellhead, frac head, night cap tools and configurations.

Another objective of the disclosure is to provide the ability for various diameter circular devices to be installed simultaneously for pre-programmed deployment.

A further objective is to provide for electronically controlling deployment from an electronic user interface or control panel from a safe working distance.

An apparatus of this nature will be capable of configurations to allow human access from a minimum elevation and provide the ability to swivel out of the paths of other equipment being used on location near the wellhead, frac head, or night cap.

An apparatus of this nature will have the capability of being contained in a pressure bearing jacket to permit deployment under wellhead pressure.

This apparatus will have the foundation for adaptation to a subsea environment for deployment of other circular devices of varying diameters.

Further, an apparatus of this nature will provide for expanding the circular device capacity without changes to the deployment method.

It is also an objective of the apparatus to provide for mechanical and digital indication of circular device status, count, characteristics, etc.

A specific embodiment of the present disclosure is an apparatus for deploying a circular device in a wellbore, comprising a frame housing an actuator and a slidebar, wherein the actuator moves the slidebar between a first position and a second position, and wherein the slidebar has a recess positioned on a lower surface of the slidebar; a magazine connected to a lower surface of the frame, the magazine comprising a spring-biased follower configured to press a circular device into the frame, wherein, in the first position, the recess of the slidebar is configured to receive the circular device from the magazine; and a chute connected to the lower surface of the frame, wherein, in the second position, the recess of the slidebar is configured to release the circular device from the recess into the chute and into a wellbore.

In some embodiments, the magazine has a channel extending along a length of the magazine, and a handle extends from the follower, through the channel, and to an external environment so that the handle can be moved to change a position of the follower within the magazine. In various embodiments, the channel has a locking end to receive the handle and hold the follower, and wherein the locking end extends along only a portion of the length of the magazine. In some embodiments, at least a portion of the locking end of the channel is substantially parallel with and offset from a remaining portion of the channel.

In various embodiments, the chute extends both downwardly and laterally from the lower surface of the frame. In some embodiments, the actuator moves the slidebar in a linear direction between the first and second positions. In various embodiments, the lower surface of the slidebar has a first portion with the recess and a distinct, non-recessed second portion, and said second portion holds a second circular device in the magazine when the slidebar is in the second position.

Another particular embodiment of the present disclosure is a system for deploying circular devices down a wellbore, comprising a wellbore having an upper end; a frame housing an actuator and a slidebar, wherein the actuator moves the slidebar between a first position and a second position, and wherein the slidebar has a recess positioned on a lower surface of the slidebar, and the recess is configured to receive a circular device; and a chute connected to the lower surface of the frame, wherein a distal end of the chute is positioned above the upper end of the wellbore, and, in the second position, the recess of the slidebar is configured to release the circular device from the recess into the chute and into the wellbore.

In various embodiments, the system further comprises a magazine connected to a lower surface of the frame, the magazine comprising a spring-biased follower configured to press the circular device into the frame, wherein, in the first position, the recess of the slidebar is configured to receive the circular device from the magazine. In some embodiments, the circular device is part of a plurality of circular devices positioned in the magazine, and at least one circular device of the plurality of circular devices has a different size than another circular device of the plurality of circular devices. In various embodiments, the upper end of the wellbore comprises at least one of a frac cap or a night cap. In some embodiments, the circular device is a frac ball having a spherical shape.

In various embodiments, the system further comprises a seal positionable over the upper end of the wellbore and configured to isolate a pressure within the wellbore after the circular device is released into the wellbore; and a pump operably connected to the wellbore and configured to increase the pressure in the wellbore. In some embodiments, the system further comprises a control panel operably connected to the actuator, wherein a signal transmitted from the control panel to the actuator causes the actuator to move the slidebar from the first position to the second position.

A further particular embodiment of the present disclosure is a method of deploying a circular device down a wellbore, comprising providing a frame housing an actuator configured to move a slidebar, wherein the slidebar has a recess positioned on a lower surface of the slidebar; providing a chute connected to the lower surface of the frame, wherein a distal end of the chute is positioned above an upper end of a wellbore; loading a circular device into the recess when the slidebar is in a first position; moving, by the actuator, the slidebar from the first position to a second position where the circular device is released from the recess, through the chute, and into the upper end of the wellbore; and sealing the upper end of the wellbore and increasing a pressure within the wellbore.

In various embodiments, the method further comprises causing, via a control panel operably connected to the actuator, the actuator to move the slidebar from the first position to the second position. In some embodiments, the method further comprises detecting, by a sensor, when the circular device has passed through the chute and sending a corresponding signal to the control panel. In various embodiments, the method further comprises providing a magazine that is connected to a lower surface of the frame; and biasing, via a follower positioned in the magazine, the circular device into the recess of the slidebar. In some embodiments, the method further comprises locking the follower at a distal end of the magazine. In various embodiments, the actuator moves the slidebar from the first position to the second position by a distance along a longitudinal axis.

These and other advantages will be apparent from the disclosure(s) contained herein. The above-described embodiments, objectives, and configurations are neither complete nor exhaustive. The Summary is neither intended nor should it be construed as being representative of the full extent and scope of the disclosure. Moreover, references made herein to "the disclosure" or aspects thereof should be understood to mean certain embodiments of the disclosure and should not necessarily be construed as limiting all embodiments to a particular description. The disclosure is set forth in various levels of detail in the Summary as well as in the attached drawings and Detailed Description and no limitation as to the scope of the disclosure is intended by either the inclusion or non-inclusion of elements, components, etc. in this Summary. Additional aspects of the disclosure will become more readily apparent from the Detailed Description particularly when taken together with the drawings.

BRIEF DESCRIPTION OF THE DRAWINGS

The accompanying drawings, which are incorporated in and constitute a part of the specification, illustrate embodiments of the disclosure and together with the general description of the disclosure given above and the detailed description of the drawings given below, serve to explain the principles of the disclosures.

It should be understood that the drawings are not necessarily to scale, and various dimensions may be altered. In certain instances, details that are not necessary for an understanding of the disclosure or that render other details difficult to perceive may have been omitted. It should be understood, of course, that the disclosure is not necessarily limited to the particular embodiments illustrated herein.

DETAILED DESCRIPTION

The disclosure has significant benefits across a broad spectrum of endeavors. It is the Applicant's intent that this specification and the claims appended hereto be accorded a breadth in keeping with the scope and spirit of the disclosure being disclosed despite what might appear to be limiting language imposed by the requirements of referring to the specific examples disclosed. To acquaint persons skilled in the pertinent arts most closely related to the disclosure, a preferred embodiment that illustrates the best mode now contemplated for putting the disclosure into practice is described herein by, and with reference to, the annexed drawings that form a part of the specification. The exemplary embodiment is described in detail without attempting to describe all of the various forms and modifications in which the disclosure might be embodied. As such, the embodiments described herein are illustrative, and as will become apparent to those skilled in the arts, and may be modified in numerous ways within the scope and spirit of the disclosure.

Although the following text sets forth a detailed description of numerous different embodiments, it should be understood that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning.

Figure 1A:
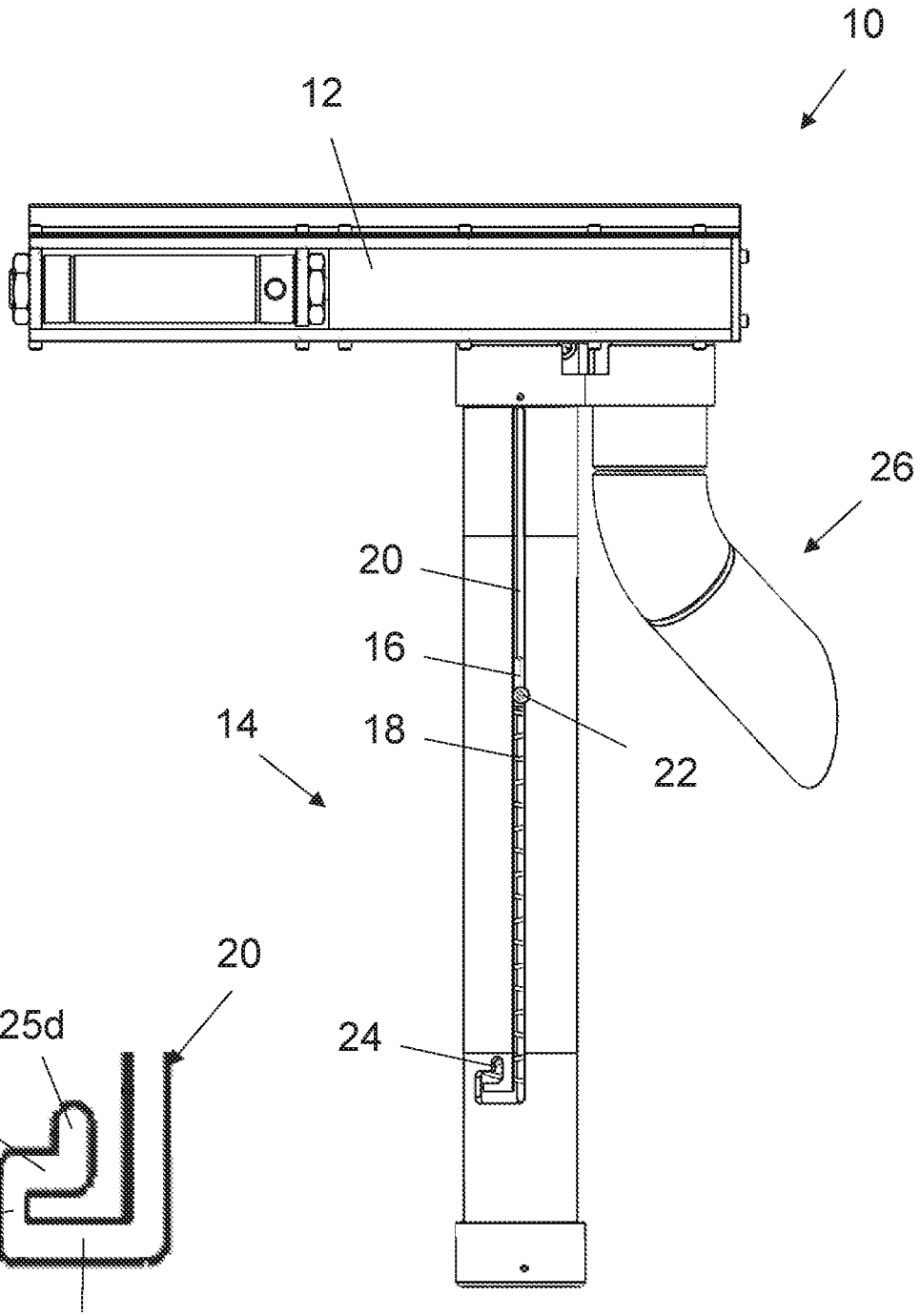
FIG. 1A is a side elevation view of an apparatus for deploying circular devices in a wellbore in accordance with embodiments of the present disclosure.
Figure 1B:
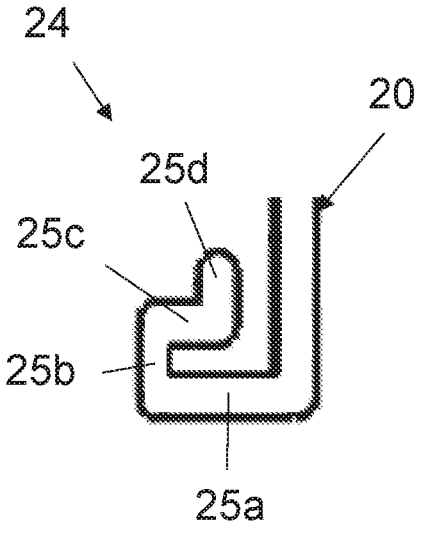
FIG. 1B is a detailed view of a locking end of a channel of the apparatus in FIG. 1A in accordance with embodiments of the present disclosure.
Figure 2:
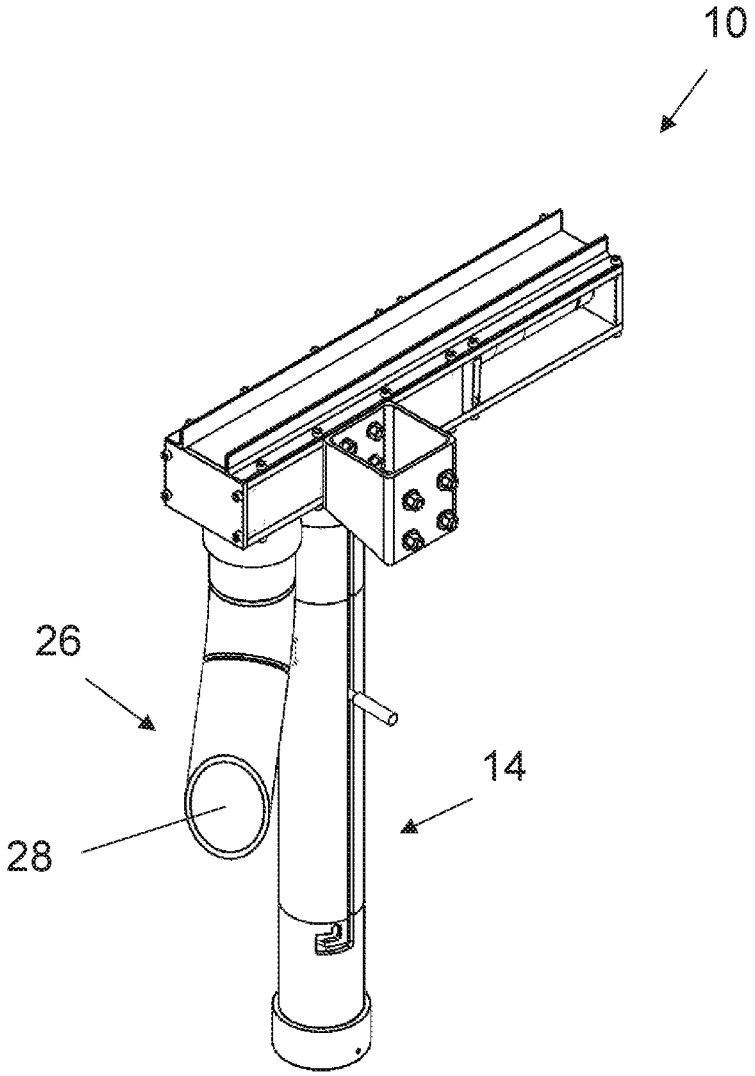
FIG. 2 is a perspective view of the apparatus in FIG. 1 in accordance with embodiments of the present disclosure.

Now referring to FIGS. 1A-2, a side elevation view and a perspective view of an apparatus 10 for deploying circular devices, such as frac balls, into a wellbore are provided. The apparatus 10 generally comprises a frame 12 to which a magazine 14 and a chute 26 are connected. The magazine 14 comprises a follower 16 that is pushed upward by a spring 18. The follower 16 then presses the circular devices loaded in the magazine 14 upward into the frame 12. A handle 20 connected to the follower 16 extends outside of the magazine 14 through a channel 22 in the magazine 14. An actuator and barslide in the frame 12 selectively deploy the circular devices, such as frac balls, through the chute 26, and past an outlet 28 and into the wellbore.

A worker can push the handle 20 into a locking end 24 of the channel 22 to prevent the follower 16 from pressing upward on the circular devices. FIG. 1B shows the locking end 24 having different subchannels 25*a*-25*d*. A first transverse subchannel 25*a* extends perpendicularly away from a lower end of the remaining portion of the channel 20. Then, a first parallel subchannel 25*b* extends substantially parallel to the remaining portion of the channel 20. Next, a second transverse subchannel 25*c* extend towards the remaining portion of the channel 20. The second transverse subchannel 25*c* is oriented substantially parallel to the first transverse subchannel 25*a* and is shorter than the first transverse subchannel 25*a*. Finally, a second parallel subchannel 25*d* extends upward and parallel to the remaining portion of the channel 20. It will be appreciated that these subchannels 25*a*-25*d* are only an exemplary embodiments, and that other embodiments of the present disclosure can have a locking end 24 with out configurations or no locking end 24 at all.

Figure 3:
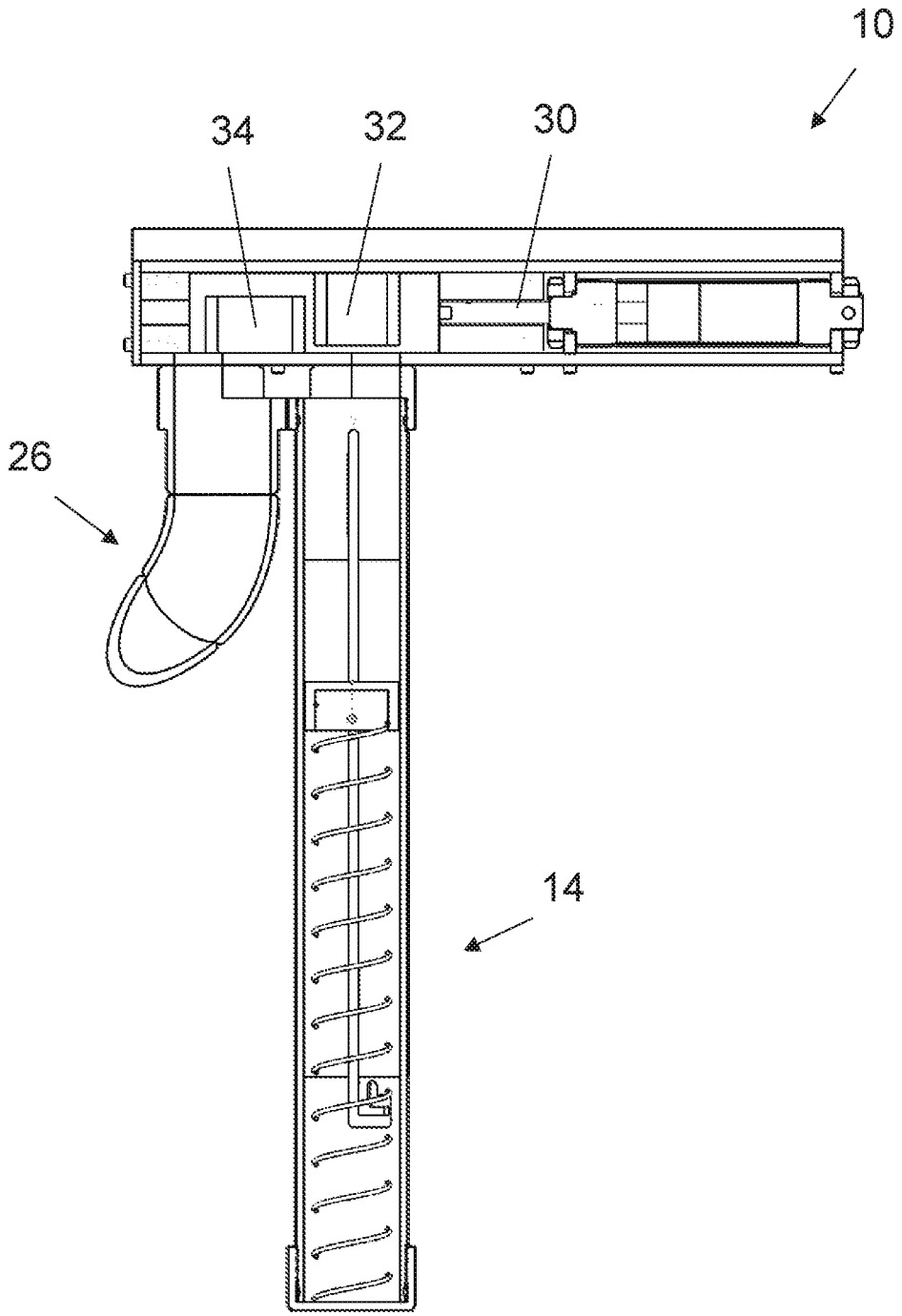
FIG. 3 is a cross-sectional, side elevation view of the apparatus in FIG. 1 with an actuator in an extended position in accordance with embodiments of the present disclosure.
Figure 4:
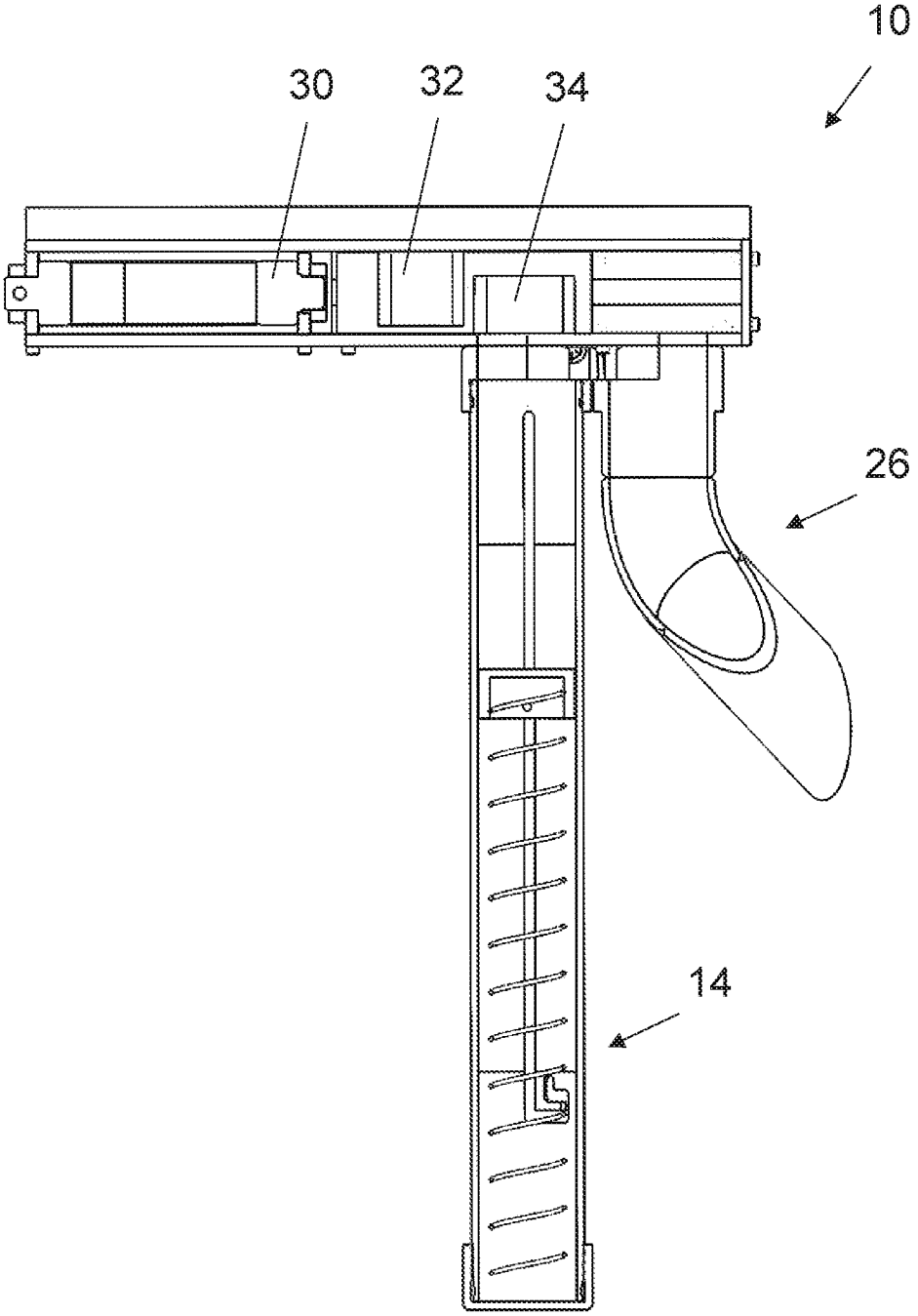
FIG. 4 is a further cross-sectional, side elevation view of the apparatus in FIG. 1 with an actuator in a retracted position in accordance with embodiments of the present disclosure.
Figure 5:
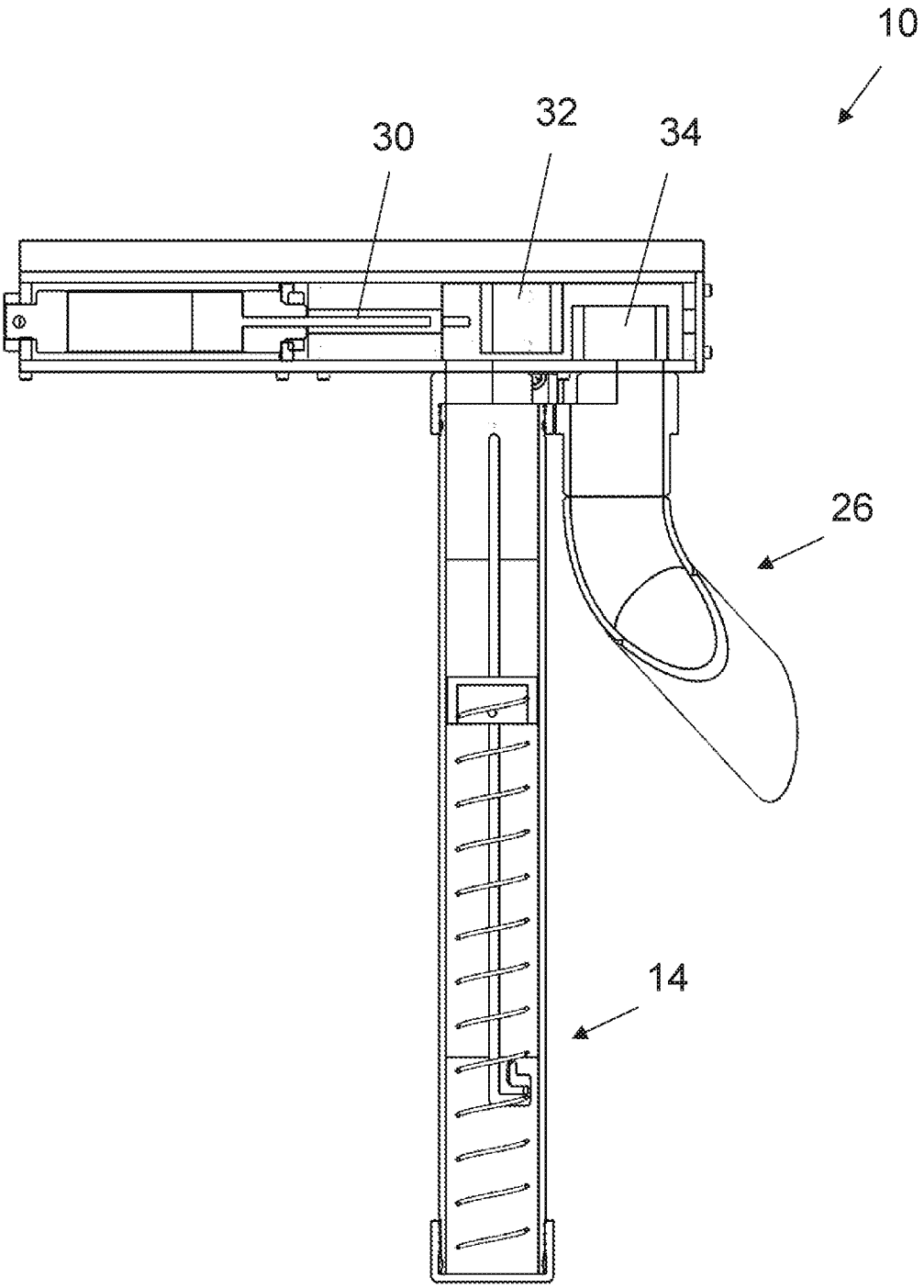
FIG. 5 is a further cross-sectional, side elevation view of the apparatus in FIG. 1 with an actuator in an extended position in accordance with embodiments of the present disclosure.

FIGS. 3-5 show cross-sectional, side elevation views of the apparatus 10 where an actuator 30 is extended in FIGS. 3 and 5 and retracted in FIG. 4. A barslide 32 is positioned in the frame adjacent to the actuator 30. The barslide 32 has a recess 34 on a lower surface that is configured to receive a circular device from the magazine 14. During operation, the spring-biased follower pushes a circular device into the recess 34 when the actuator 30 is in a retracted position. Then, the actuator 30 pushes the barslide 32 to a second position such that the recess 34 is over the chute 26. The circular device falls out of the recess 34 and into the chute 26, and then into the wellbore. It will be appreciated that the bottom of the barslide 32 can have recess 34 on one portion and no recess on another portion such when the barslide 32 is in the second position the non-recessed portion prevents any circular devices from entering the barslide 32 or the frame 12. Moreover, the circular devices or frac balls can be loaded into the magazine 14 in descending or ascending sizes to seal off formations deeper in the well and then closer as more frac balls enter the well.

Figure 6:
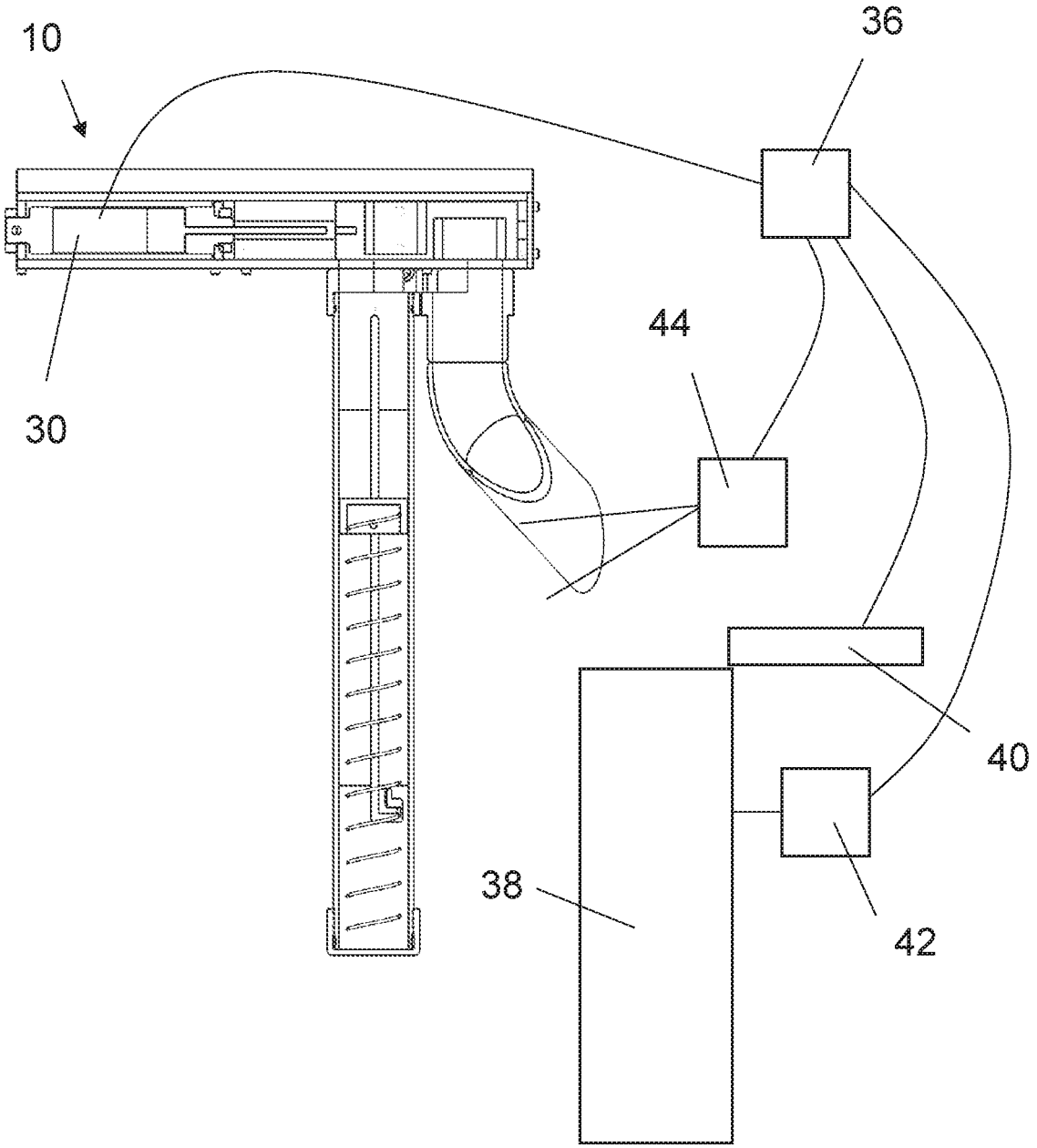
FIG. 6 is a cross-sectional side elevation view of a system for deploying circular devices in a wellbore in accordance with embodiments of the present disclosure.

Now referring to FIG. 6, a cross-sectional side elevation view of a system for deploying circular devices in a wellbore is provided. The apparatus 10 has components such as a magazine, a slidebar, an actuator, and a chute as described elsewhere herein. In addition, this embodiment include a control panel 36 from which an operator can cause various components to take certain actions and/or the operator can receive feedback from various components. For instance, the wellbore 38 has a seal 40 located at an upper end of the wellbore 38. After deploying one or more circular devices into the wellbore 38, the seal 40 can be moved over the upper end to isolate a pressure within the wellbore 38. Then, a pump 42 can increase a pressure within the wellbore 38.

Also shown in FIG. 6 is a sensor 44 that detects when a circular device is passing through the chute and into the wellbore. The sensor 44 can be, for instance, an inductive or capacitive sensor for detecting an object. Some or all of these devices can be operated remoted from the control panel 36.

Figure 7:
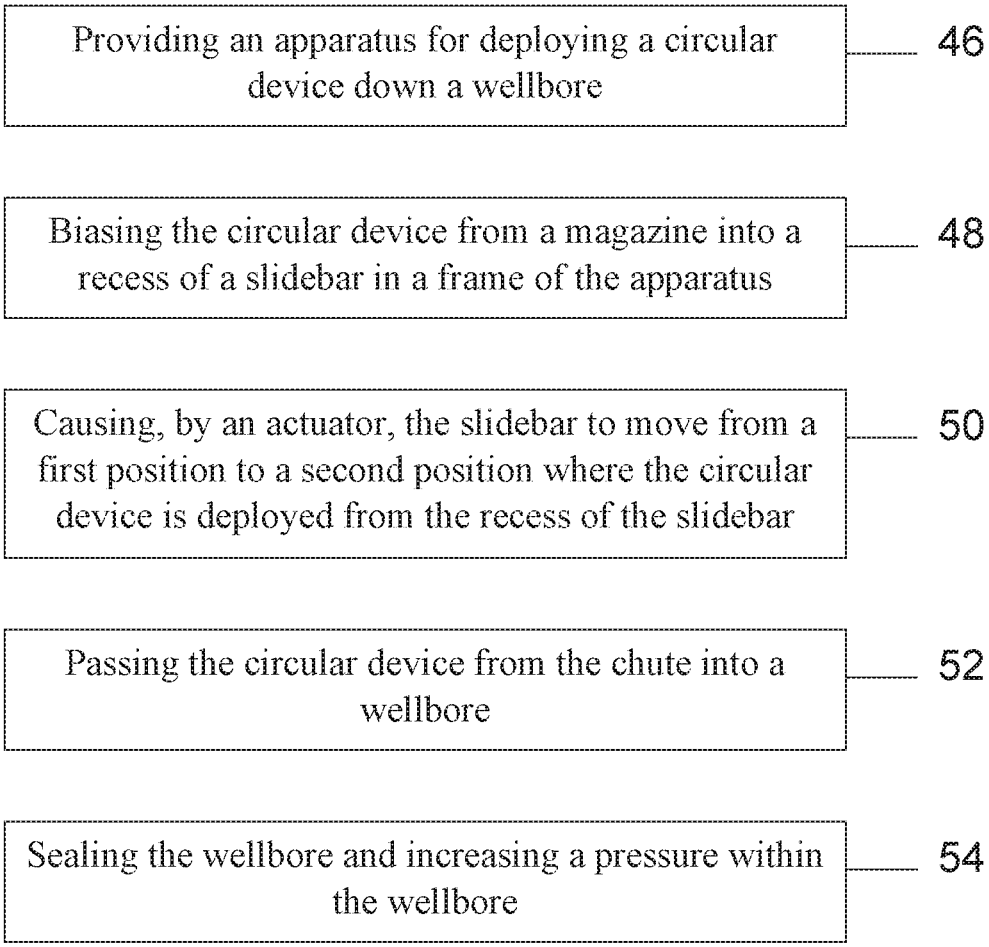
FIG. 7 is a flowchart for a method for deploying circular devices in a wellbore in accordance with embodiments of the present disclosure.

Now referring to FIG. 7, a flowchart for a method of deploying circular devices into a wellbore is provided. An embodiment of the apparatus described herein is provided 46, and a magazine feeds or biases 48 a circular device into a recess of a slidebar. Then, an actuator moves 50 the slidebar from a first position to a second position, and the circular device is released 52 into a chute and into a wellbore, which can be sealed 54 and increased in pressure.

In various embodiments, a remotely operated device drops frac balls into the wellhead of an oil and gas well. The ball drop comprises a tubular, spring loaded magazine, connected to the head, capable of holding a specified range of differing diameter frac balls. A head comprising a remotely controlled actuator, a slide bar propelled and retracted by the actuator to move the balls from the magazine to the outlet chute and a frame to encompass the actuator and slide bar. The slide bar comprises a ball recess to contain a frac ball of differing diameters and ball block to keep additional frac balls from entering the outlet chute. An outlet chute, connected to the head, to direct the frac ball into the wellhead. Also, a control panel with or without control lines to remotely send and receive signals to and from the ball drop device.

The ball drop is located above the wellhead, frac head, night cap, or other devices connected to the top of the wellhead, and positioned in a manner to allow the ball to be dropped into the device which would be at atmospheric pressure at the time of the drop of the ball. The ball drop can also be mounted onto a device that can remotely alter the position and orientation of the ball drop, to allow the ball drop to be moved out of the way of other equipment while not in operation.

The ball drop has two main positions of operation, the open and the closed position or, alternatively, first and second positions. Typically, the ball drop begins in the closed position with the magazine loaded with frac balls and the slide positioned to receive a frac ball in the recess. Once in position above the wellhead a signal is sent from the control box to the actuator causing the actuator to move the slide from the closed position to the open position. This movement of the actuator moves the slide recess, which contains one frac ball, from the magazine to the outlet chute. The ball then travels through the outlet chute where it contacts a device which will provide a visual signal on the ball drop and a remote signal on the control panel to let the operator know that the ball has been dropped in the chute.

The ball then continues through the outlet chute and the drops from the outlet chute, through the air, and into the wellhead. The top of the wellhead can then be closed by the operation designated for the wellhead.

Once the wellhead is closed, pressure can be applied to the wellhead to force the ball downhole. After the ball has been dropped a signal is sent by the operator to move the ball drop into the closed position. This loads another ball into the recess of the slide and readies the ball drop to drop the next ball.

To provide additional background, context, and to further satisfy the written description requirements of 35 U.S.C. § 112, the following references are incorporated by reference herein in their entireties: U.S. Pat. No. 8,869,883 and U.S. Publication No. 2008/0223587.

The disclosure has significant benefits across a broad spectrum of endeavors. It is the Applicant's intent that this specification and the claims appended hereto be accorded a breadth in keeping with the scope and spirit of the disclosure being disclosed despite what might appear to be limiting language imposed by the requirements of referring to the specific examples disclosed.

The phrases "at least one", "one or more", and "and/or", as used herein, are open-ended expressions that are both conjunctive and disjunctive in operation. For example, each of the expressions "at least one of A, B, and C", "at least one of A, B, or C", "one or more of A, B, and C", "one or more of A, B, or C," and "A, B, and/or C" means A alone, B alone, C alone, A and B together, A and C together, B and C together, or A, B, and C together.

Unless otherwise indicated, all numbers expressing quantities, dimensions, conditions, and so forth used in the specification, drawings, and claims are to be understood as being modified in all instances by the term "about."

The term "a" or "an" entity, as used herein, refers to one or more of that entity. As such, the terms "a" (or "an"), "one or more" and "at least one" can be used interchangeably herein.

The use of "including," "comprising," or "having," and variations thereof, is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C. § 112(f). Accordingly, a claim incorporating the term "means" shall cover all structures, materials, or acts set forth herein, and all of the equivalents thereof. Further, the structures, materials, or acts, and the equivalents thereof, shall include all those described in the Summary, Brief Description of the Drawings, Detailed Description, Abstract, and claims themselves.

The foregoing description of the disclosure has been presented for illustration and description purposes. However, the description is not intended to limit the disclosure to only the forms disclosed herein. In the foregoing Detailed Description for example, various features of the disclosure are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the disclosure.

Consequently, variations and modifications commensurate with the above teachings and skill and knowledge of the relevant art are within the scope of the disclosure. The embodiments described herein above are further intended to explain best modes of practicing the disclosure and to enable others skilled in the art to utilize the disclosure in such a manner, or include other embodiments with various modifications as required by the particular application(s) or use(s) of the disclosure. Thus, it is intended that the claims be construed to include alternative embodiments to the extent permitted by the prior art.

What is claimed is:

1. An apparatus for deploying a circular device in a wellbore, comprising:

a frame housing an actuator and a slidebar, wherein the actuator is configured to move the slidebar between a first position and a second position, and wherein the slidebar has a recess positioned on a surface of the slidebar;

a magazine connected to a surface of the frame, the magazine comprising a spring-biased follower configured to press a circular device into the frame, wherein, in the first position, the recess of the slidebar is configured to receive the circular device from the magazine, wherein the magazine has a channel extending along a length of the magazine, and a handle extends from the follower, through the channel, and to an external environment so that the handle can be moved to change a position of the follower within the magazine; and a chute connected to the surface of the frame, wherein, in the second position, the recess of the slidebar is configured to release the circular device from the recess into the chute and into a wellbore.

2. The apparatus of claim 1, wherein the channel has a locking end to receive the handle and hold the follower, and wherein the locking end extends along only a portion of the length of the magazine.

3. The apparatus of claim 2, wherein at least a portion of the locking end of the channel is substantially parallel with and offset from a remaining portion of the channel.

4. The apparatus of claim 1, wherein the chute extends both downwardly and laterally from the surface of the frame.

5. The apparatus of claim 1, wherein the actuator moves the slidebar in a linear direction between the first and second positions.

6. The apparatus of claim 1, wherein the surface of the slidebar has a first portion with the recess and a distinct, non-recessed second portion, and said second portion holds a second circular device in the magazine when the slidebar is in the second position.

7. A system for deploying circular devices down a wellbore, comprising:

a wellbore having an upper end;

a frame housing an actuator and a slidebar, wherein the actuator is configured to move the slidebar between a first position and a second position, and wherein the slidebar has a recess positioned on a surface of the slidebar, and the recess is configured to receive a circular device;

a chute connected to a surface of the frame, wherein a distal end of the chute is positioned above the upper end of the wellbore, and, in the second position, the recess of the slidebar is configured to release the circular device from the recess into the chute and into the wellbore; and a magazine connected to a surface of the frame, the magazine comprising a spring-biased follower configured to press a circular device into the frame, wherein, in the first position, the recess of the slidebar is configured to receive the circular device from the magazine, wherein the magazine has a channel extending along a length of the magazine, and a handle extends from the follower, through the channel, and to an external environment so that the handle can be moved to change a position of the follower within the magazine.

8. The system of claim 7, wherein the circular device is part of a plurality of circular devices positioned in the magazine, and at least one circular device of the plurality of circular devices has a different size than another circular device of the plurality of circular devices.

9. The system of claim 7, wherein the upper end of the wellbore includes a movable seal configured to isolate a pressure within the wellbore.

10. The system of claim 7, wherein the circular device is a frac ball having a spherical shape.

11. The system of claim 7, further comprising:

a seal positionable over the upper end of the wellbore and configured to isolate a pressure within the wellbore after the circular device is released into the wellbore; and a pump operably connected to the wellbore and configured to increase the pressure in the wellbore.

12. The system of claim 7, further comprising:

a control panel operably connected to the actuator, wherein a signal transmitted from the control panel to the actuator causes the actuator to move the slidebar from the first position to the second position.

13. A method of deploying a circular device down a wellbore, comprising:

providing a frame housing an actuator configured to move a slidebar, wherein the slidebar has a recess positioned on a surface of the slidebar;

providing a chute connected to a surface of the frame, wherein a distal end of the chute is positioned above an upper end of a wellbore;

loading a circular device into the recess when the slidebar is in a first position;

moving, by the actuator, the slidebar from the first position to a second position where the circular device is released from the recess, through the chute, and into the upper end of the wellbore;

sealing the upper end of the wellbore and increasing a pressure within the wellbore;

causing, via a control panel operably connected to the actuator, the actuator to move the slidebar from the first position to the second position; and detecting, by a sensor, when the circular device has passed through the chute and sending a corresponding signal to the control panel.

14. The method of claim 13, further comprising:

providing a magazine that is connected to the surface of the frame; and biasing, via a follower positioned in the magazine, the circular device into the recess of the slidebar.

15. The method of claim 14, further comprising:

locking the follower at a distal end of the magazine.

16. The method of claim 13, wherein the actuator moves the slidebar from the first position to the second position by a distance along a longitudinal axis.

* * * * *